US007354026B2

(12) United States Patent
Urrutia

(10) Patent No.: US 7,354,026 B2
(45) Date of Patent: Apr. 8, 2008

(54) UNITARY BLADE SEAL FOR A SHEARING BLIND RAM IN A RAM TYPE BLOWOUT PREVENTER

(75) Inventor: Miguel Urrutia, Katy, TX (US)

(73) Assignee: Cameron International Corporation, Houston, TX (US)

( * ) Notice: Subject to any disclaimer, the term of this patent is extended or adjusted under 35 U.S.C. 154(b) by 209 days.

(21) Appl. No.: 10/919,945

(22) Filed: Aug. 17, 2004

(65) Prior Publication Data

US 2006/0038147 A1 Feb. 23, 2006

(51) Int. Cl.
*E21B 33/06* (2006.01)

(52) U.S. Cl. ..... 251/1.3; 251/1.1

(58) Field of Classification Search ..... 251/1.1, 251/1.3

See application file for complete search history.

(56) References Cited

U.S. PATENT DOCUMENTS

| | | | | |
|---|---|---|---|---|
| 3,766,979 A | | 10/1973 | Petrick | 166/55 |
| 3,817,326 A | * | 6/1974 | Meynier, III | 166/55 |
| 3,909,017 A | * | 9/1975 | Engstrom | 251/327 |
| 4,081,027 A | | 3/1978 | Nguyen | 166/55 |
| 4,132,266 A | * | 1/1979 | Randall | 166/55 |
| 4,265,424 A | * | 5/1981 | Jones | 251/1.3 |
| 4,341,264 A | | 7/1982 | Cox et al. | 166/55 |
| 4,347,898 A | | 9/1982 | Jones | 166/55 |
| 4,518,144 A | * | 5/1985 | Vicic et al. | 251/1.3 |
| 4,537,250 A | * | 8/1985 | Troxell, Jr. | 166/55 |
| 4,540,046 A | | 9/1985 | Granger et al. | 166/55 |
| 4,692,104 A | * | 9/1987 | Hansen | 418/61.1 |
| 5,005,802 A | | 4/1991 | McWhorter et al. | 251/1.3 |
| 5,360,061 A | | 11/1994 | Womble | 166/55 |
| 5,515,916 A | * | 5/1996 | Haley | 166/55 |
| 5,713,581 A | | 2/1998 | Carlson et al. | 277/188 R |
| 6,158,505 A | * | 12/2000 | Araujo | 166/55 |
| 7,207,382 B2 | | 4/2007 | Schaeper | |

* cited by examiner

*Primary Examiner*—John Rivell
*Assistant Examiner*—Andrew J Rost
(74) *Attorney, Agent, or Firm*—Conley Rose, P.C.

(57) ABSTRACT

A unitary blade seal for a shearing blind ram of a ram-type blowout preventer is disclosed and includes an elongate member having a generally semi-circular cross section with a curved upper surface and a lower surface. The lower surface has a pair of laterally extending sides that taper outwardly and have a metal outer cap bonded thereto. The metal outer caps form an acute angle that engages a complementary groove formed in the upper ram of the shearing blind ram assembly.

10 Claims, 4 Drawing Sheets

UNITARY BLADE SEAL FOR A SHEARING BLIND RAM IN A RAM TYPE BLOWOUT PREVENTER

BACKGROUND OF THE INVENTION

1. Field of the Invention

This invention relates to a unitary, i.e., one piece, blade seal for use in a shearing blind ram for a ram-type blowout preventer used in oil and gas drilling operations. Ram-type blowout preventers are part of a pressure control system used in oil and gas drilling operations to control unexpected well bore pressure spikes or kicks as they are commonly referred to in the industry.

The blowout preventer has a body with a vertical bore and a pair of laterally disposed opposing bonnet assemblies. Each bonnet assembly includes a piston which is laterally moveable within the bonnet assembly by pressurized hydraulic fluid. Replaceable sealing elements called packers are mounted on the ends of the pistons which extend into the blowout preventer bore. When these pistons are moved to a closed position, commonly referred to as "closing the blowout preventer" or "closing the rams", the vertical bore of the blowout preventer is sealed and the kick is contained. These packers are available in a variety of configurations designed to seal the blowout preventer bore when the opposing pistons are moved to their closed position. One type of packer has ends designed to seal around pipe of a specific size in the blowout preventer bore when the blowout preventer is closed. Other rams are designed to shear through a drill pipe section extending through the vertical bore and seal off the bore. It is this type, commonly referred to as blind shear rams and the blade seal to be used therein to which the present invention is directed.

These shearing blind rams face a formidable task. They must be able to shear through a piece of drill pipe in the blowout preventer bore and then seal against each other to contain the well bore pressure during a kick. The shearing blind rams must form a pressure tight seal during a kick until the well bore pressure can be controlled which can reach several thousand pounds per square inch. The shearing blind ram has various rubber seal elements attached to it to ensure a complete seal of the blowout preventer bore.

These seal elements, including the blade seal of the present invention, are exposed to tremendous well bore pressures. The blade seal of the current invention offers a substantial improvement by offering a simple, easy to manufacture blade seal that minimizes wear and tear of the elastomeric seal element with a pair of end caps to minimize extrusion of the seal element.

2. Description of Related Art

Various types of shearing blind rams with various blade seals have been shown and used.

U.S. Pat. No. 3,766,979 to J. T. Petrick shows a well casing cutter uitilizing O rings to seal around the casing being cut.

The ram-type blowout preventer shown in U.S. Pat. No. 3,817,326 to M. J. Meynier III discloses a blade seal with the rubber element bonded to a metal member.

U.S. Pat. No. 4,081,027 to T. X. T. Nguyen. shows a shearing ram for hydrogen sulfide service utilizing a rubber element bonded to the shear ram to seal after shearing.

The wellhead shearing apparatus shown in U.S. Pat. No. 4,341,264 to F. H. Cox et al. discloses a rubber element bonded in a recessed groove in a shearing ram to act as a blade seal.

U.S. Pat. No. 4,347,898 to M. R. Jones shows a shear ram blowout preventer utilizing a rectangular seal in the lower face of the upper ram as a blade seal.

A shearing ram utilizing a pair of hardened points to aid in initiating the shearing action is shown in U.S. Pat. No. 4,537,250 to J. N. Troxell, Jr. A plain rectangular seal acts as a blade seal.

The shear ram apparatus shown in U.S. Pat. No. 4,540,046 to S. W. Granger et al. discloses a blade seal with the rubber element bonded to a metal member.

U.S. Pat. No. 5,005,802 to D. J. McWhorter et al. shows a variable bore packer for a ram type blowout preventer.

U.S. Pat. No. 5,360,061 to L. M. Womble shows a blowout preventer with tubing shear rams designed to control the shape of the sheared pipe end.

The shear ram apparatus shown in U.S. Pat. No. 5,515,916 to T. D. Haley discloses a blade seal with the rubber element bonded to a metal member and a metal insert in the rubber element to aid in sealing.

U.S. Pat. No. 5,713,581 to D. W. Carlson et al. shows a blade seal of nitrile rubber with uniformly dispersed synthetic, non-cellulosic fibers to aid in preventing seal rollover.

U.S. Pat. No. 6,158,505 to R. Araujo shows a blade seal design utilizing a pair of tapered blade seal elements to effectuate sealing.

SUMMARY OF THE INVENTION

The blade seal for a shearing blind ram of the present invention is designed for use in a standard ram-type blowout preventer used in oil and gas drilling operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The blade seal includes an elongate member having a generally semi-circular cross section with a curved upper surface and a substantially flat lower surface. The flat lower surface has a pair of laterally extending sides that taper outwardly and have a metal outer cap bonded thereto. The metal outer caps form an acute angle that engages a complementary groove formed in the upper ram of the shearing blind ram assembly. The opposing lower ram has a upwardly facing surface that seals against the blade seal after the pipe is sheared.

A principal object of the present invention is to provide a unitary blade seal for use in shearing blind rams that has an improved life cycle and fits in existing blowout preventers.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
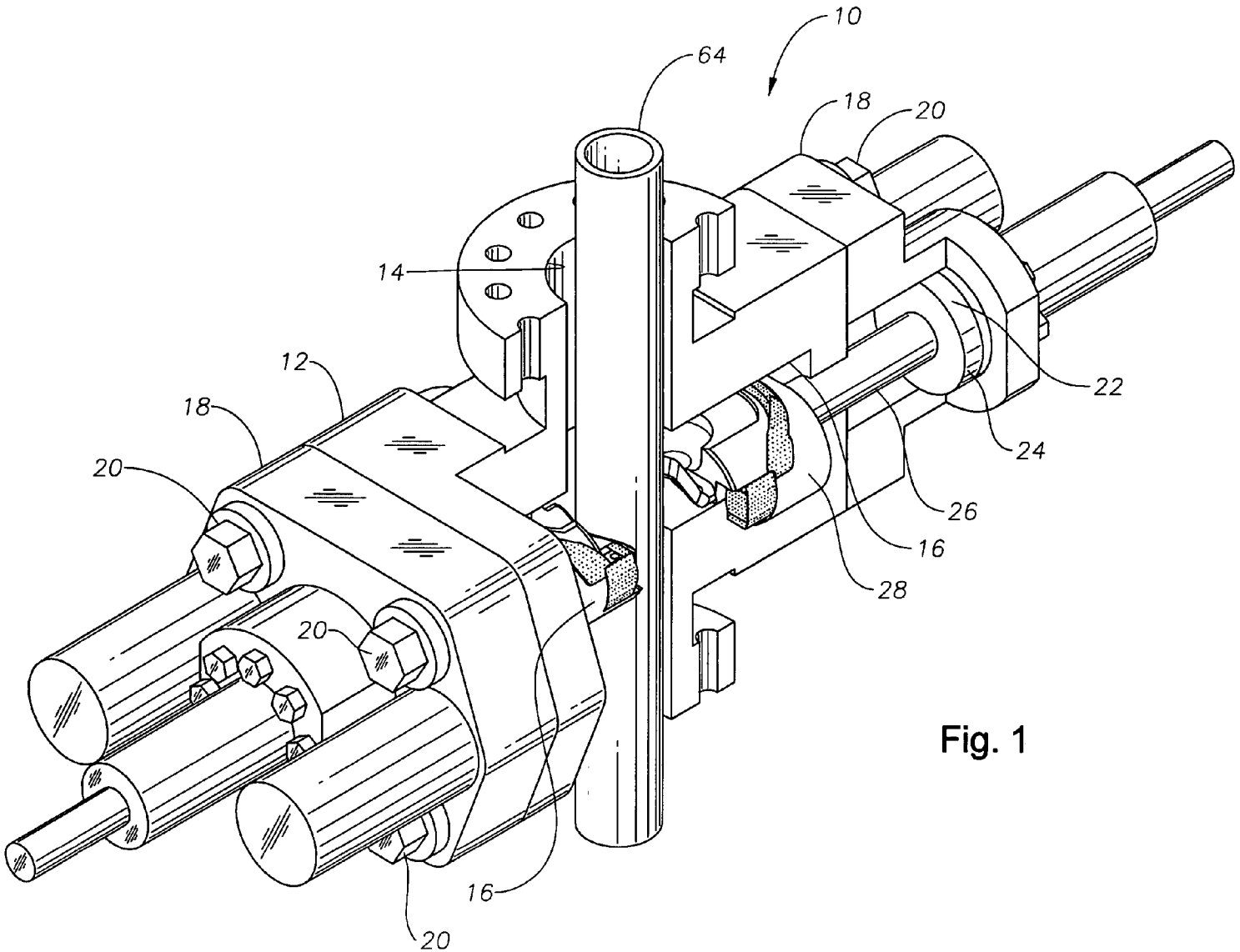
FIG. 1 is a perspective view with a cutaway section of a shearing blind ram assembly utilizing the blade seal of the present invention installed in a typical ram-type blowout preventer used in oil and gas drilling operations.

With reference to the drawings, and particularly to FIG. 1, an isometric view of a ram type blowout preventer 10 used in oil and gas drilling operations is shown. The ram type blowout preventer 10 includes a body or housing 12 with a vertical bore 14 and laterally disposed ram guideways 16. Bonnet assemblies 18 are mounted to the body 12 with bolts 20 and aligned with laterally disposed guideways 16. Each bonnet assembly 18 includes an actuation means 22, including a piston 24 and connecting rod 26. While only one guideway 16 and actuation means 22 is shown, it is understood by those of ordinary skill in the art that there is a pair of opposed guideways 16 and actuation means 22. Each connecting rod 26 is connected to a shearing blind ram assembly 28. Shearing blind ram assembly 28 includes a blade seal 30 of the present invention. Actuation means 22 allows ram and shearing blind ram assembly 28 to be reciprocated within guideways 16.

Figure 2:
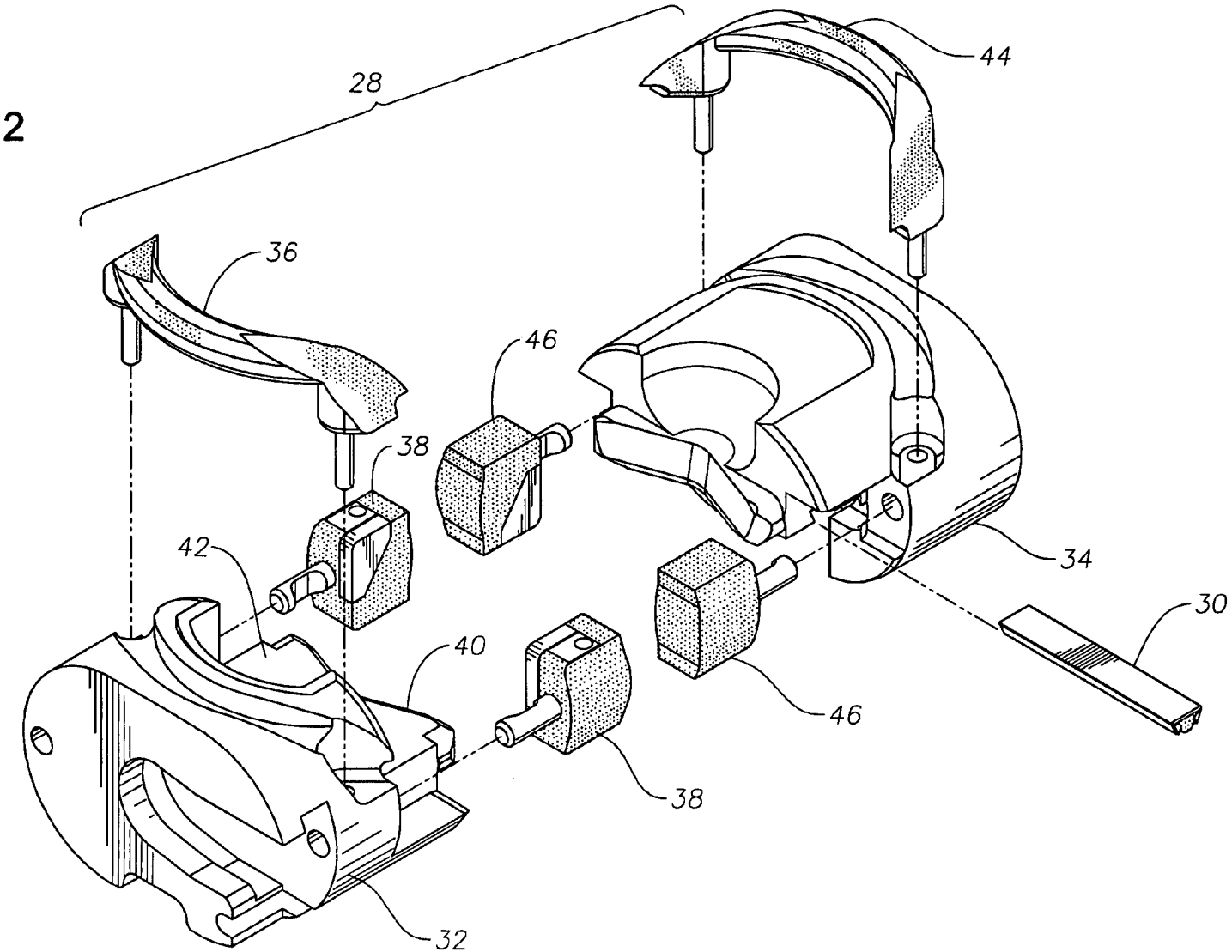
FIG. 2 is an exploded view of the shearing blind ram assembly.

Shearing blind ram assembly 28 is shown in an exploded view in FIG. 2 to aid in understanding the relationship between the parts. Shearing blind ram assembly 28 includes lower ram 32 and upper ram 34. Lower ram 32 includes top seal 36 and side seals 38 that seal against guideways 16. Lower ram 32 includes shear blade 40 positioned on its leading edge and seal surface 42. Upper ram 34 includes top seal 44 and side seals 46 that seal in guideways 16 in a manner similar to lower ram 32. Blade seal 30 is positioned on the lower face of upper ram 34.

Figure 3:
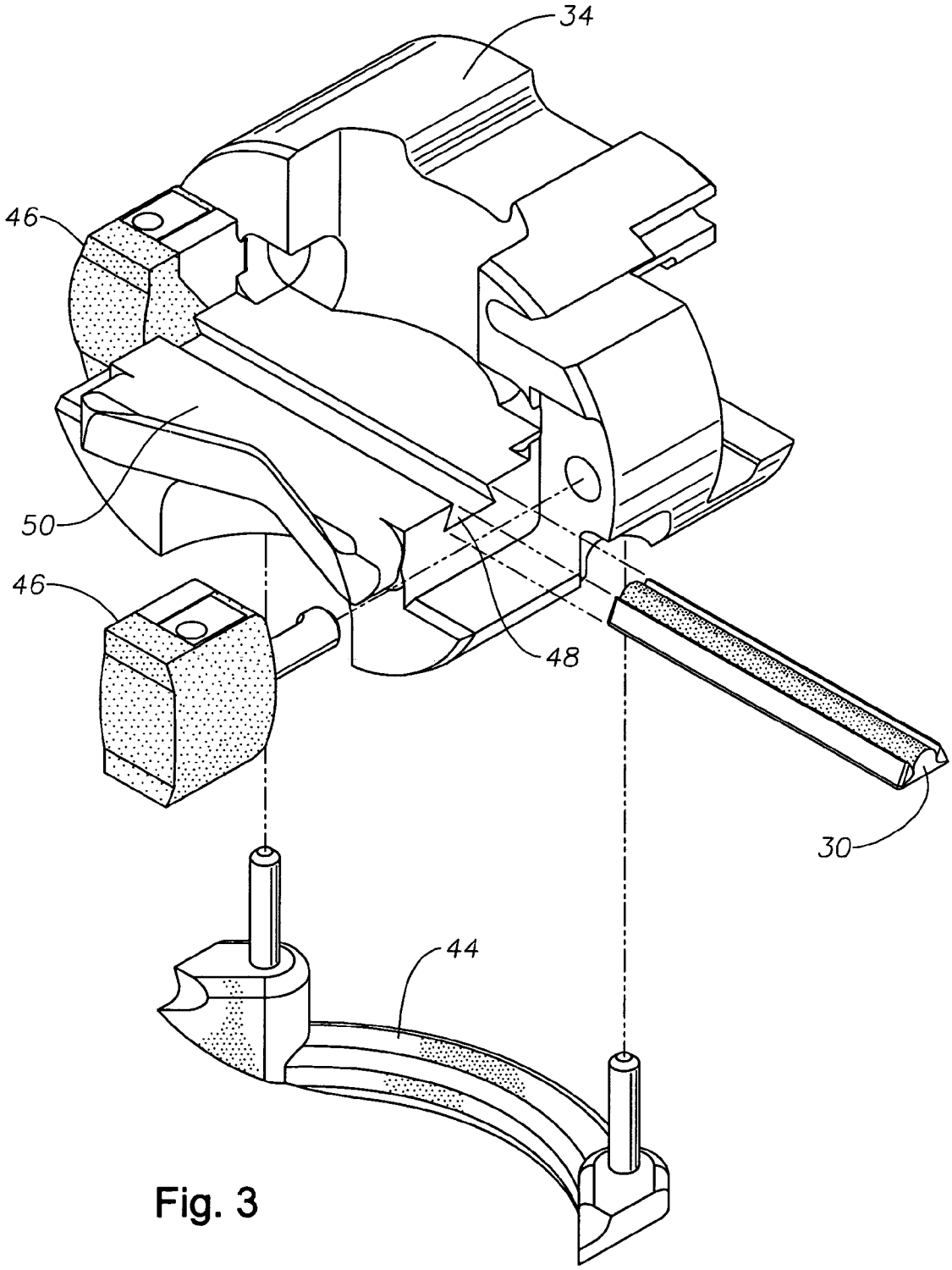
FIG. 3 is a partially exploded view of the upper ram of a shearing blind ram assembly shown in an inverted position.

Referring to FIG. 3, upper ram 34 is shown inverted from its position of FIG. 2 to better illustrate the positioning of blade seal 30 therein. A trapezoidal or "dove tail" shaped groove 48 are machined in lower face 50 of upper ram 34. Trapezoidal or "dove tail" shaped groove 48 extends the full width of upper ram 34.

Figure 4:
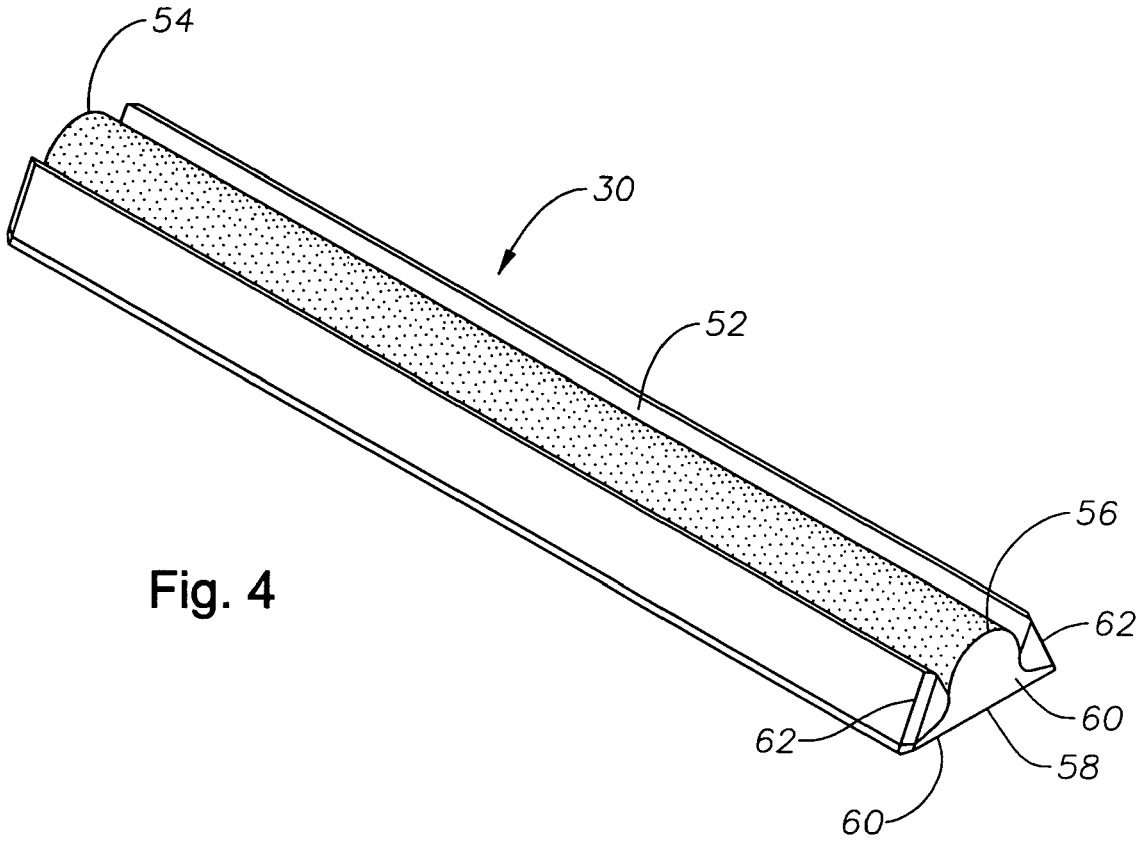
FIG. 4 is a perspective view of the blade seal of the present invention.

As best seen in FIG. 4, blade seal 30 includes a generally elongate member 52 formed of molded rubber or other suitable elastomeric material having a generally semi-circular cross section 54. Semi-circular cross section 54 has a curved upper surface 56 and substantially flat lower surface 58. Flat lower surface 58 has a pair of laterally extending sides 60 that taper outwardly from semi-circular cross section 54. Outer caps 62 are bonded to laterally extending sides 60 in a manner well known to those of ordinary skill in the art. Outer caps 62 are formed of metal or similarly suitable stiff material and positioned at an acute angle for engagement with complementary trapezoidal or "dove tail" shaped groove 48 in upper ram 34 to ensure blade seal 30 is held securely in position.

Figure 5:
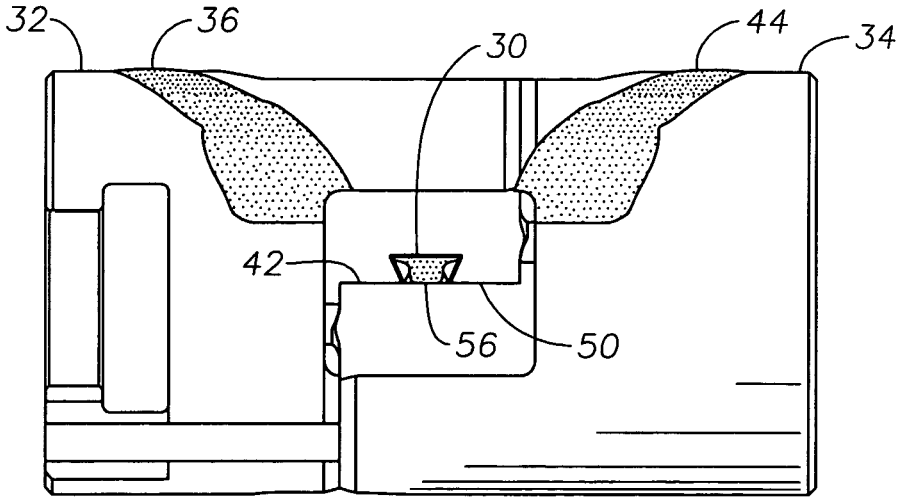
FIG. 5 is an elevation view showing the shearing blind ram assembly after closing of the blowout preventer and the blade seal sealing between the upper and lower rams.

A typical sequence of operation is as follows. With shearing blind ram assembly 28 installed in blowout preventer 10, the rams are closed. This causes pipe 64 to be sheared and lower face 50 of upper ram 34 and seal surface 42 of lower ram 32 to slide over one another in close fitting relationship. Continued movement causes seal surface 42 of lower ram 32 to contact and seal against curved upper surface 56 of blade seal 30 as best seen in FIG. 5. Top seals 36 and 44 and side seals 38 and 46 also seal against guideways 16 to ensure a complete seal of the vertical bore 14 after shearing.

The construction of my unitary blade seal for a shearing blind ram will be readily understood from the foregoing description and it will be seen that I have provided a unitary blade seal that has an improved life cycle and fits in existing blowout preventers. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims

What is claimed is:

1. A ram-type blowout preventer for oil and gas drilling operations including a shearing blind ram, comprising:

a body with a vertical bore;

a pair of opposing bonnet assemblies laterally disposed in said body;

a pair of opposing shearing blind rams laterally moveable within said bonnet assemblies;

a blade seal for sealing against an opposing shearing blind ram disposed in one of said shearing blind rams;

said blade seal including a curved upper surface and a lower surface, said lower surface including a pair of laterally extending sides tapering outwardly from said lower surface, said pair of laterally extending sides each including an outer metal cap bonded to said laterally extending sides;

said outer caps forming an acute angle for engagement with a complementary groove formed in said shearing blind ram;

said curved upper surface extending above said outer caps; and, said blade seal is molded of rubber.

2. A shearing blind ram assembly for a ram-type blowout preventer used in oil and gas drilling operations, comprising:

an upper ram and a lower ram;

said upper ram and said lower ram including top seals and side seals for sealing in a guideway of a ram-type blowout preventer;

a blade seal positioned on the lower face of said upper ram;

said lower ram including a seal surface for engagement with said blade seal when said shearing blind ram assembly is closed; said blade seal including a generally semi-circular cross section;

said generally semi-circular cross section including a curved upper surface and a lower surface, said lower surface including a pair of laterally extending sides tapering outwardly from said lower surface, said pair of laterally extending sides each including an outer metal cap bonded to said laterally extending sides;

said outer caps forming an acute angle for engagement with a complementary groove formed in said shearing blind ram;

said curved upper surface extending above said outer caps; and, said generally semi-circular cross section is molded of rubber.

3. A blade seal for a shearing blind ram for a ram-type blowout preventer used in oil and gas drilling operations, comprising:

an elongate member having a curved upper surface and a lower surface, said lower surface including a pair of laterally extending sides tapering outwardly from said lower surface, said pair of laterally extending sides each including an outer metal cap bonded to said laterally extending sides;

said outer caps forming an acute angle for engagement with a complementary groove formed in the shearing blind ram;

said curved upper surface extending above said outer caps; and, said elongate member is molded of rubber.

4. A blade seal for a shearing blind ram for a ram-type blowout preventer used in oil and gas drilling operations, comprising:

an elongate member comprising a curved front surface and a rear surface, said rear surface comprising a pair of laterally extending sides tapering outwardly from said rear surface;

a metal retainer disposed along each of said laterally extending sides, said retainers and said elongate member being integrally formed together as one piece;

said retainers forming an acute angle for engagement with a complementary groove formed in the shearing blind ram;

said curved front surface extending past said retainers; and, said elongate member is molded of rubber.

5. A ram-type blowout preventer for oil and gas drilling operations including a shearing blind ram, comprising:

a body with a vertical bore;

a pair of opposing bonnet assemblies laterally disposed in said body;

a pair of opposing shearing blind rams laterally moveable within said bonnet assemblies;

a blade seal for sealing against an opposing shearing blind ram disposed in one of said shearing blind rams;

said blade seal comprising a curved front surface and a rear surface, said rear surface comprising a pair of laterally extending sides tapering outwardly from said rear surface;

a metal retainer disposed along each of said laterally extending sides, said retainers and said blade seal being integrally formed together as one piece;

said retainers forming an acute angle for engagement with a complementary blade seal support formed in the shearing blind ram;

said curved front surface extending past said retainers;

said blade seal being slidable into said blade seal support in said shearing blind ram; and, said blade seal is molded of rubber.

6. A ram-type blowout preventer for oil and gas drilling operations including a shearing blind ram, comprising:

a body with a vertical bore;

a pair of opposing bonnet assemblies laterally disposed in said body;

a pair of opposing shearing blind rams laterally moveable within said bonnet assemblies;

a blade seal configured to seal against an opposing shearing blind ram and disposed in one of said shearing blind rams;

said blade seal comprising a front engagement surface and a rear surface, said rear surface comprising a pair of laterally extending sides tapering outwardly from said rear surface;

a metal retainer disposed along at least a portion of each of said laterally extending sides, said retainers and said blade seal being integrally formed together as one piece;

said retainers forming an acute angle for engagement with a complementary blade seal support formed in the shearing blind ram; and said front engagement surface extending past said retainers.

7. A ram-type blowout preventer for oil and gas drilling operations including a shearing blind ram according to claim 6, wherein said blade seal is disposed in a dove-tail type groove.

8. A ram-type blowout preventer for oil and gas drilling operations including a shearing blind ram according to claim 6, wherein at least one of said retainers covers a substantial portion of a side surface of said blade seal.

9. A blade seal for a shearing blind ram for a ram-type blowout preventer used in oil and gas drilling operations, comprising:

an elongate member comprising a curved engagement surface and a second surface generally opposite the engagement surface, said second surface comprising a pair of laterally extending sides tapering outwardly from said rear surface, said pair of laterally extending sides each comprising an outer metal cap bonded to said laterally extending sides;

said outer caps forming an acute angle for engagement with a complementary groove formed in said shearing blind ram;

said curved engagement surface extending above said outer caps; and, said elongate member is molded of rubber.

10. A blade seal for a shearing blind ram for a ram-type blowout preventer used in oil and gas drilling operations according to claim 9, wherein at least one of said outer caps covers a substantial portion of a side surface located between the engagement surface and the second surface.

* * * * *